US005321933A

United States Patent [19]

Seifert et al.

[11] Patent Number: 5,321,933

[45] Date of Patent: Jun. 21, 1994

[54] METHOD OF AND APPARATUS FOR APPLYING LABELS TO CONTAINERS

[75] Inventors: Günter Seifert, Burg; Christian Kliewe, Gross-Stove, both of Fed. Rep. of Germany

[73] Assignee: Alfill Getränketechnik GmbH, Hamburg, Fed. Rep. of Germany

[21] Appl. No.: 24,484

[22] Filed: Mar. 1, 1993

[30] Foreign Application Priority Data

Mar. 3, 1992 [DE] Fed. Rep. of Germany ..... 4206594

[51] Int. Cl.[5] ..... B65B 61/00

[52] U.S. Cl. ..... 53/415; 53/399; 156/215

[58] Field of Search ..... 53/136.1, 137.2, 214, 53/216, 399, 415, 587; 156/215, DIG. 11, DIG. 12, DIG 13, DIG. 26, DIG. 35

[56] References Cited

U.S. PATENT DOCUMENTS 3,843,963 9/1974 Hoffman ..... 156/215
4,108,709 8/1978 Hoffmann ..... 156/215 X
4,574,020 3/1986 Fosnaught ..... 156/215 X
4,661,188 4/1987 Fumei ..... 156/244.11
4,735,668 4/1988 Hoffmann et al. ..... 156/215
4,844,760 7/1989 Dickey ..... 156/215

*Primary Examiner*—John Sipos
*Assistant Examiner*—Daniel Moon
*Attorney, Agent, or Firm*—Darby & Darby

[57] ABSTRACT

Containers for beverages are rotated about their own axes and are simultaneously transported past a water applying sponge and thereupon past an applicator of labels which completely surround the peripheral surfaces of the respective containers so that the leader of each label is overlapped by its trailing end. The films of water which are applied by the sponge reduce the likelihood of slippage of labels relative to the peripheral surfaces during draping of the labels, and such films evaporate when the application of labels is completed so that the labels surround but do not adhere to the containers. The trailing ends of the labels are coated with adhesive which bonds them to the respective leaders.

3 Claims, 1 Drawing Sheet

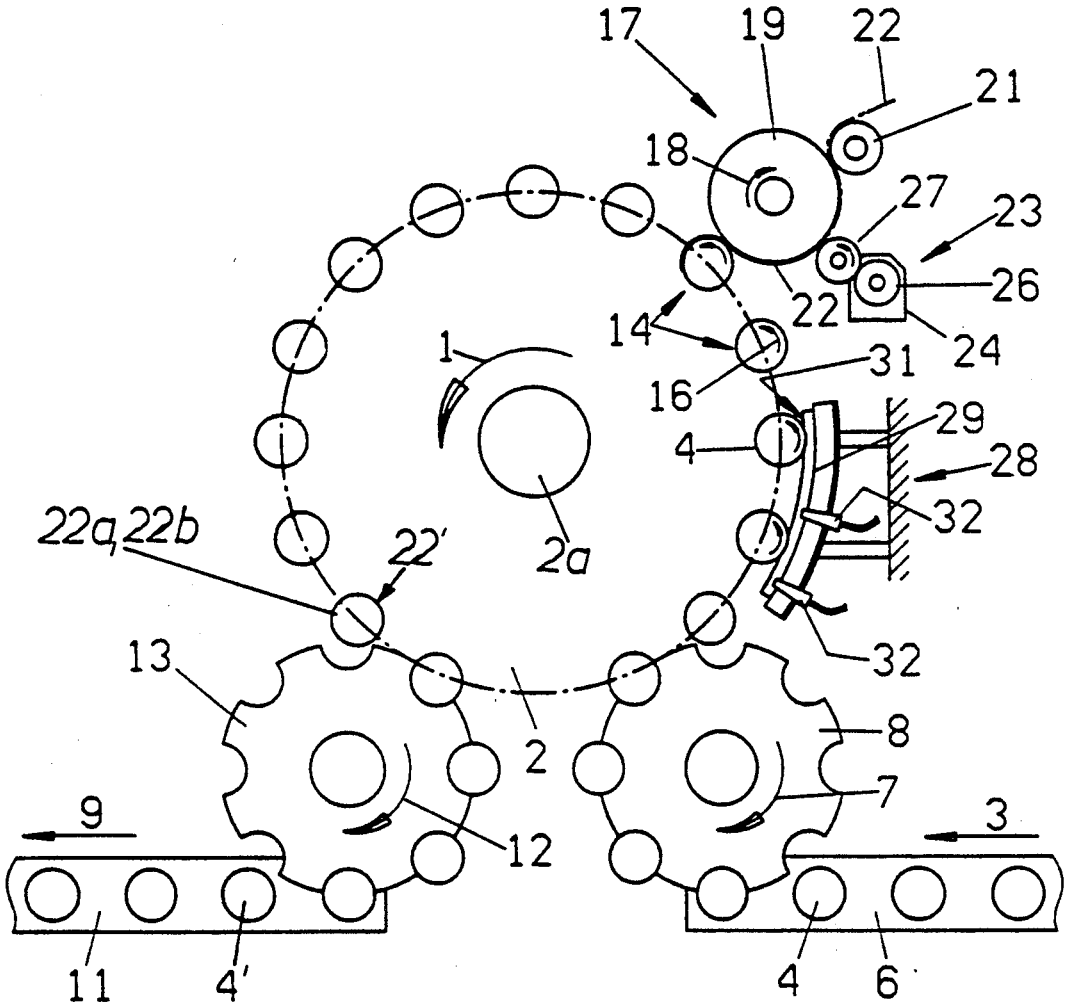
17
19
22
21
18
27
23
26
22
24
14
31
1
16
29
4
28
32
22a,22b
22'
2a
32
13
2
8
7
9
12
3
11
4'
4
6

METHOD OF AND APPARATUS FOR APPLYING LABELS TO CONTAINERS

BACKGROUND OF THE INVENTION

The invention relates to improvements in methods of and in apparatus applying wrappers to various objects, and more particularly to improvements in methods of and in apparatus for applying flexible wrappers (such as labels) to containers in the form of bottles, cans or the like. Still more particularly, the invention relates to improvements in methods of and in apparatus for the application of labels or analogous wrappers of the type suitable for draping all around the at least partially cylindrical peripheral or external surfaces of bottles, cans or analogous containers.

Containers which can be provided with wrappers in accordance with the method and in the apparatus of the present invention can include bottles of glass or plastic material (such as PET), cans of metallic or other material and like receptacles, especially for beverages. The wrappers which are to be applied in accordance with the method of and in the apparatus of the present invention can be made of paper or other suitable material. A presently preferred material is a shrinkable polymer, such as polypropylene.

OBJECTS OF THE INVENTION

An object of the invention is to provide a method which can be practiced with advantage in connection with the application of labels or other flexible wrappers to reusable containers for beverages or the like.

Another object of the invention is to provide a method which renders it possible to reliably apply labels to bottles, cans or analogous containers in such a way that an applied label can be readily and completely detached from the respective container in a simple, inexpensive and time-saving manner.

A further object of the invention is to provide a method which renders it possible to reuse containers for beverages or the like as often as desired.

An additional object of the invention is to provide a method which renders it possible to apply labels in a predictable manner, without slippage and in such a way that an applied label surrounds a selected portion of the peripheral surface of the respective container.

Still another object of the invention is to provide a method which can be resorted to for the application of conventional labels to conventional containers for beverages or the like.

A further object of the invention is to provide a novel and improved apparatus for the practice of the above outlined method.

Another object of the invention is to provide the apparatus with novel and improved means for preventing slippage of wrappers during application to moving containers for beverages or the like.

An additional object of the invention is to provide the apparatus with novel and improved means for preventing permanent or long-lasting adherence of wrappers to containers or other objects.

Still another object of the invention is to provide an apparatus which can be installed in existing production lines for turning out long or short series of containers for soft drinks, alcoholic beverages or the like.

Another object of the invention is to provide a label applying apparatus which meets the requirements and regulations of authorities in charge of ecology. An additional object of the invention is to provide a production line for beverage-filled containers which embodies an apparatus of the above outlined character.

SUMMARY OF THE INVENTION

One feature of the present invention resides in the provision of a method of applying around a peripheral surface of a container a flexible wrapper having a leader, a trailing end and a length sufficient to completely surround the peripheral surface so that the trailing end overlies the leader of the properly applied wrapper. The improved method comprises the steps of establishing a temporary bond at least between the leader of the wrapper and the peripheral surface of the container, convoluting the wrapper around the peripheral surface so that the trailing end overlies the leader and affixing the trailing end to the leader, and terminating the bond between the wrapper and the peripheral surface of the container.

The wrapper can constitute a label of paper or the like, and the peripheral surface can constitute an at least substantially (partially) cylindrical surface.

The step of establishing a temporary bond can include wetting the peripheral surface of the container, and such wetting step can comprise applying to at least a portion of the peripheral surface an evaporable liquid which is free of solvents and/or adhesives. Such liquid can be water, e.g., pure water.

The wetting step can include coating at least a major portion of the peripheral surface with a film of water.

The affixing step can comprise adhesively bonding the trailing end to the leader of the wrapper.

Another feature of the invention resides in the provision of an apparatus for applying flexible wrappers around at least substantially cylindrical peripheral surfaces of successive containers of a series of containers. The improved apparatus comprises means for transporting successive containers of the series in a predetermined direction along a predetermined path including means for rotating the containers about the axes of the respective at least substantially cylindrical surfaces, means for at least partially coating the peripheral surfaces of successive containers with films of an evaporable liquid in a first portion of the path, and means for draping wrappers around the peripheral surfaces of successive containers in a second portion of the path downstream of the first portion.

The coating means can include a wetting device having a surface which is adjacent the first portion of the path and is configurated to contact the peripheral surfaces of successive containers while the containers rotate about the axes of the respective peripheral surfaces. The wetting device of the coating means can include at least one sponge and means for supplying a solvent- and adhesive-free liquid to the at least one sponge. The at least one sponge is preferably provided with a film-applying surface which conforms to the first portion of the path and contacts the peripheral surfaces of successive containers while the containers rotate about the axes of their respective peripheral surfaces. The rotating means can comprise a file of spaced-apart neighboring carriers for discrete containers, and the film-applying surface of the at least one sponge can have a length (as measured in the predetermined direction) at least matching the spacing between neighboring carriers of the file. The supplying means can comprise at least one nozzle which is designed to deliver water droplets to the at least one sponge.

The apparatus can be utilized with advantage for the application of flexible wrappers each of which has a leader, a trailing end and a length sufficient to completely surround the peripheral surface of a container so that the trailing end can overlie the leader. The draping means of such apparatus can comprise means for applying an adhesive to the leader and/or to the trailing end of each wrapper so that the trailing end of each convoluted wrapper is bonded to the respective leader. The applying means can comprise a paster for the trailing ends of the wrappers. The wrappers can constitute labels, and the containers can constitute bottles or cans for beverages or the like.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single FIGURE of the drawing is a schematic plan view of an apparatus which embodies one form of the invention and is designed to apply labels to cylindrical peripheral surfaces of bottles, cans or other containers for beverages or the like, the apparatus being in the process of applying labels to each of a single series of containers while the containers rotate about the axes of their cylindrical peripheral surfaces.

DESCRIPTION OF PREFERRED EMBODIMENTS

The apparatus which is shown in the drawing comprises a transporting unit for cylindrical or substantially cylindrical containers 4 in the form of bottles, cans or the like. The transporting unit comprises a rotary conveyor 2 which is continuously driven by an upright shaft 2a to rotate in the direction of the arrow 1 and defines an elongated arcuate path for successive containers 4 of a shorter or longer series of such containers. The conveyor 2 supports an annulus of equidistant carriers 14 each of which is rotated about its own vertical axis X; such axis coincides with the axis of the cylindrical peripheral surface 5 on the container 4 which is supported by the respective carrier. The carriers 14 are or can be designed in such a way that they support the containers 4 in suspended position during transport along an elongated arcuate path from a rotary container-supplying conveyor 8 to a rotary container-accepting conveyor 13. The conveyor 8 is driven in the direction of arrow 7 in synchronism with the conveyor 2 and receives unlabelled containers 4 from a further conveyor 6 whereon the containers advance in the direction of arrow 3. The conveyor 13 is driven in the direction of arrow 12 and delivers labelled containers 4' to a further conveyor 11 which advances such containers in the direction of arrow 9, e.g., to storage or to a boxing or crating station, not shown.

The reference character 17 denotes a draping unit which applies flexible wrappers 22 to the peripheral surfaces 5 of successive containers 4 in a portion of the arcuate path downstream of a path portion for wetting the peripheral surfaces 5 with films of pure water or another readily evaporable liquid. The draping unit 17 comprises a cylindrical draping element 19 which is rotated in the direction of arrow 18 and receives successive wrappers 22 from a suitable source (e.g., a stack of labels), not shown. The wrappers 22 are urged against the peripheral surface of the element 19 by an idler roller 21. The element 19 can attract the wrappers 22 by suction and causes the wrappers to advance along a paster 23 which constitutes a means for applying adhesive to the trailing ends 22b of successive wrappers. The paster 23 includes a tank 24 for a supply of a suitable adhesive, a first roller 26 which dips into the supply of adhesive in the tank 24, and a second roller 27 which receives a film of adhesive paste from the roller 26 in such a way that it applies adhesive only to the trailing ends 22b of successive wrappers. This can be achieved, for example, by providing the peripheral surface of the roller 27 with one or more raised portions which receive adhesive from the roller 26.

A unit 28 serves to at least partially coat the major portions of or the entire peripheral surfaces 5 of successive containers 4 with films of pure water or another liquid which is free of solvents and/or adhesives. The unit 28 includes an elongated arcuate wetting device 29 in the form of a sponge having a concave surface 31 which conforms to adjacent portion of the path for the containers 4 and contacts the peripheral surfaces 5 while the respective containers rotate about their axes X with the corresponding carriers 14. The means for supplying droplets of water to the sponge 29 comprises one or more nozzles 32. The length of the concave surface 31 at least equals the spacing between neighboring carriers 14 at the periphery of the conveyor 2.

The mode of operation of the apparatus which is shown in the drawing is as follows:

The conveyor 8 accepts successive undraped (unlabelled) containers 4 from the conveyor 6 and advances them to successive carriers 14 on the conveyor 1. The concave surface 31 of the sponge 29 provides the peripheral surfaces 5 of successive containers 4 with films or layers of water, preferably in such a way that at least the major portion of each peripheral surface 5 is coated with liquid. The position of the concave surface 31 can be selected with a view to ensure that the sponge 29 wipes the peripheral surfaces 5 of successive containers 4 while the containers advance with the conveyor 2 in the direction of arrow 1 and while the containers 4 also rotate about the axes X of their respective peripheral surfaces 5 (such rotational movements are imparted by the respective carriers 14 which share the movements of the conveyor 2 and rotate relative to the conveyor 2 in the directions indicated by arrows 16).

The leader of a wrapper 22 is attached to the water-coated portion of the peripheral surface 5 of the oncoming container 4 during advancement of such container past the draping unit 17 whereby the liquid film reduces the likelihood of slippage of the leader 22a relative to the peripheral surface 5. The draping of the wrapper 22 continues as the respective container 4 moves past the roller 19 (which is rotated in the direction of the arrow 18) so that the wrapper is tightly wound around the respective peripheral surface 5 and its trailing end 22b overlies and is bonded to the leader 22a. The film of water which was applied by the surface 31 of the sponge 29 evaporates sooner or later so that a properly applied wrapper constitutes a sleeve-like cylindrical label 22' which tightly surrounds but is not bonded to the peripheral surface 5. However, the trailing end 22b overlies and is bonded to the respective leader 22*a* to prevent separation of the label 22' from the peripheral surface 5 of the respective container.

The wrappers 22 can be made of a material which is stretched during or immediately prior to application around the respective peripheral surfaces 5 to ensure that the thus obtained labels 22' snugly follow the outlines of the peripheral surfaces 5 but are not bonded thereto.

The strips of adhesive paste which is applied to the trailing ends 22*b* of successive wrappers 22 can be very narrow, as long as the adhesive suffices to prevent undesirable separation of the trailing ends 22*b* from the leaders 22*a* of the respective labels 22'.

Separation of a label from the respective container 4 presents no problems because the labels are not bonded to the respective peripheral surfaces. Therefore, such separation can be carried out by resorting to simple implements or apparatus in order to prepare an empty container 4 for renewed use, e.g., to refill an empty bottle with a fresh supply of an alcoholic or non-alcoholic beverage. The improved method and apparatus can be utilized with equal advantage for the application of flexible wrappers to containers which are not intended for reusing, i.e., which are to be discarded or recycled after a single use. The method and apparatus exhibit important advantages regardless of whether or not the containers 4 are to be reused. Thus, the quantity of adhesive can be reduced to a minimum, recycling presents minor problems because the labels 22' can be completely separated from the peripheral surfaces 5, and the wrappers can be applied with a high degree of accuracy and predictability because they are not likely to slip along the wetted peripheral surfaces 5 of the respective containers 4.

Though it is often sufficient to wet only a relatively small portion of the peripheral surface 5 which advances past and is contacted by the concave surface 31 of the sponge 29, a rather extensive contact is preferred in many instances because the wrappers 22 are even less likely to slip relative to the containers during conversion into cylindrical sleeve-like labels 22' or the like.

A further advantage of the improved method and apparatus is that, once the evaporation of liquid (such as pure water) which was applied by the sponge 29 is completed, the liquid does not leave any traces so that the peripheral surface 5 is ready to be surrounded by a fresh wrapper as soon as the previously applied label 22' is removed. Such removal can be carried out by ripping the label 22' open in the axial direction of the respective container 4.

The invention can be practiced in connection with the application of all kinds of wrappers including those made of paper as well as those made of a suitable plastic material. Heretofore, plastic labels were applied by employing a solvent which has caused the inner sides of plastic wrappers to adhere to the peripheral surfaces of the respective containers. Such solvents are no longer necessary, even if the wrappers 22 are made of a plastic material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of applying around a peripheral surface of a container a flexible wrapper having a leader, a trailing end and a length sufficient to completely surround the peripheral surface so that the trailing end overlies the leader, comprising the steps of establishing a temporary bond at least between the leader of the wrapper and the peripheral surface, including rotating the container about an axis of the peripheral surface and wetting at least a major portion of the peripheral surface of the rotating container with water which is free of solvents and adhesives; convoluting the wrapper around the peripheral surface so that the trailing end overlies the leader and affixing the trailing end to the leader; and terminating the bond between the wrapper and the peripheral surface.

2. The method of claim 1, wherein the wrapper is a label and the peripheral surface is an at least substantially cylindrical surface.

3. The method of claim 1, wherein said affixing step comprises adhesively bonding the trailing end to the leader of the wrapper.

* * * * *